United States Patent [19]

Yoshihara et al.

[11] Patent Number: 4,974,964

[45] Date of Patent: Dec. 4, 1990

[54] APPARATUS FOR PREPARING ELECTROPHOTOGRAPHIC PHOTOSENSITIVE MEMBERS

[75] Inventors: Toshiyuki Yoshihara, Mitaka; Yoichi Kawamorita, Yokohama; Tomohiro Kimura, Yokohama; Masaru Nakagawa, Yokohama; Masaaki Hiro, Naka, all of Japan

[73] Assignee: Canon Kabushiki Kaisha, Tokyo, Japan

[21] Appl. No.: 436,931

[22] Filed: Nov. 13, 1989

Related U.S. Application Data

[62] Division of Ser. No. 166,015, Mar. 9, 1988, abandoned.

[30] Foreign Application Priority Data

Mar. 11, 1987 [JP] Japan ..... 62-54085

[51] Int. Cl.[5] ..... B01F 15/04

[52] U.S. Cl. ..... 366/152; 118/665

[58] Field of Search ..... 366/152, 160, 161, 162; 118/665, 668, 689

[56] References Cited

U.S. PATENT DOCUMENTS

| | | | |
|---|---|---|---|
| 4,146,325 | 3/1979 | Lange | 118/665 |
| 4,506,626 | 3/1985 | Schurman | 118/665 |
| 4,724,795 | 2/1988 | Levine | 118/688 |
| 4,792,078 | 12/1988 | Takahashi | 118/688 |
| 4,832,499 | 5/1989 | Florentini | 366/152 |

*Primary Examiner*—Robert W. Jenkins

*Attorney, Agent, or Firm*—Fitzpatrick, Cella, Harper & Scinto

[57] ABSTRACT

An apparatus for preparing electrophotographic photosensitive members comprises a means for forming a charge generation layer by coating a charge generation layer coating solution containing two or more kinds of charge-generating materials having different maximum absorption wavelengths, wherein the apparatus further comprises a means for measuring absorbance or transmittance at the respective maximum absorption wavelengths of said coating solution to measure the mixing ratio of the respective charge-generating materials, and a means for controlling the mixing ratio by controlling the feed amount of the respective charge-generating materials.

4 Claims, 3 Drawing Sheets

APPARATUS FOR PREPARING ELECTROPHOTOGRAPHIC PHOTOSENSITIVE MEMBERS

This application is a division, of application Ser. No. 166,015 filed Mar. 9, 1988 now abandoned.

BACKGROUND OF THE INVENTION

The present invention relates to an apparatus for preparing electrophotographic photosensitive members, comprising a step of coating a coating solution formed by mixing two or more kinds of charge-generating materials.

Lamination type photosensitive members obtained by laminating a charge transport layer and a charge generation layer chiefly comprised of a charge-generating material have been already put into practice use as electrophotographic photosensitive members employing organic photoconductive materials. In such photosensitive members, it is possible to suitably select charge-generating materials to obtain a photosensitive members having desired spectrum sensitivities, but, when it is intended to obtain photosensitive member having a photosensitive wavelength region which is wide to a certain extent (i.e., being panchromatic), it is known to mix two or more kinds of charge-generating materials having different photosensitive wavelength regions, as disclosed in U.S. Pat. No. 3,992,205, U.S. Pat. No. 4,026,704, etc. In this instance, two or more kinds of charge-generating materials are simultaneously mixed in a binder resin and a solvent, or separately dispersed therein, followed by mixing of such materials to obtain a charge generation layer coating solution, and this solution is then coated on a substrate to form a charge generation layer.

In the instance where the electrophotographic photosensitive members are prepared with use of such a charge generation layer coating solution simultaneously containing two or more kinds of charge-generating materials, there occurs a problem as follows: The problem occurs because the mixing ratio of the respective charge-generating materials in the coating solution may change with the lapse of time because of differences in the dispersed particle size, dispersibility and agglomeration properties depending on the individual charge-generating material. This problem after tends to occur especially when using a coating medium tank comprising a filter provided in a feeding system for the charge generation layer coating solution for the purpose of removing foreign matters included in the coating process, dust inclusions from the atmosphere, coarse particles agglomerated, etc.

Under such circumstances, it is impossible to prepare photosensitive members having always constant electrophotographic properties. Accordingly, the mixing ratio of the charge-generating materials must be measured to effect feedback to a coating apparatus, but this is unsuitable for the continuous production of photosensitive members because such measurement is too time consuming.

SUMMARY OF THE INVENTION

An object of the present invention is to prepare an electrophotographic photosensitive member having always constant electrophotographic properties.

Another object of the present invention is to prepare an electrophotographic photosensitive member having always stable panchromatic characteristics.

Still another object of the present invention is to provide an apparatus for preparing electrophotographic photosensitive members, comprising a step of coating a charge generation layer coating solution containing two or more kinds of charge-generating materials, wherein the mixing ratio of the above charge-generating materials is simply and quickly measured to regulate the composition of the coating solution by automatic control and keep it always to a constant state.

Namely, according to an aspect of the present invention, there is provided an apparatus for preparing electrophotographic photosensitive members, comprising a means for forming a charge generation layer by coating a charge generation layer coating solution containing two or more kinds of charge-generating materials having different maximum absorption wavelengths, wherein the apparatus further comprises a means for measuring absorbance or transmittance at the respective maximum absorption wavelengths of said coating solution to measure the mixing ratio of the respective charge-generating materials, and a means for controlling the mixing ratio by controlling the feed amount of the respective charge-generating materials.

According to another aspect of the present invention, there is provided a method for controlling mixing ratio of charge-generating materials in a charge generation layer coating solution containing two or more kinds of charge-generating materials having different maximum absorption wavelengths, comprising measuring absorbance or transmittance at the respective maximum absorption wavelengths of said coating solution to measure the mixing ratio of the respective charge-generating materials, and controlling the feed amount of the respective charge-generating materials on the basis of a calibration curve previously made by varying the mixing ratio of the charge-generating materials, thereby keeping the mixing ratio of the charge-generating materials in said coating solution to a constant level.

DETAILED DESCRIPTION OF PREFERRED EMBODIMENTS

The present invention will be described below in detail.

Most suited as the manner by which the mixing ratio of the charge-generating materials can be simply and quickly measured is an optically measuring method. More specifically, on account of the difference in the maximum absorption wavelengths of the respective charge-generating materials, the absorbence or transmittance of the above charge generation layer coating solution at the wavelength regions within that range is measured, and a calibration curve is made in advance from the correlation between mixing ratios and absorbance or transmittance at a certain wavelength on the basis of known samples, whereby the composition of the coating solution can be determined.

Figure 1:
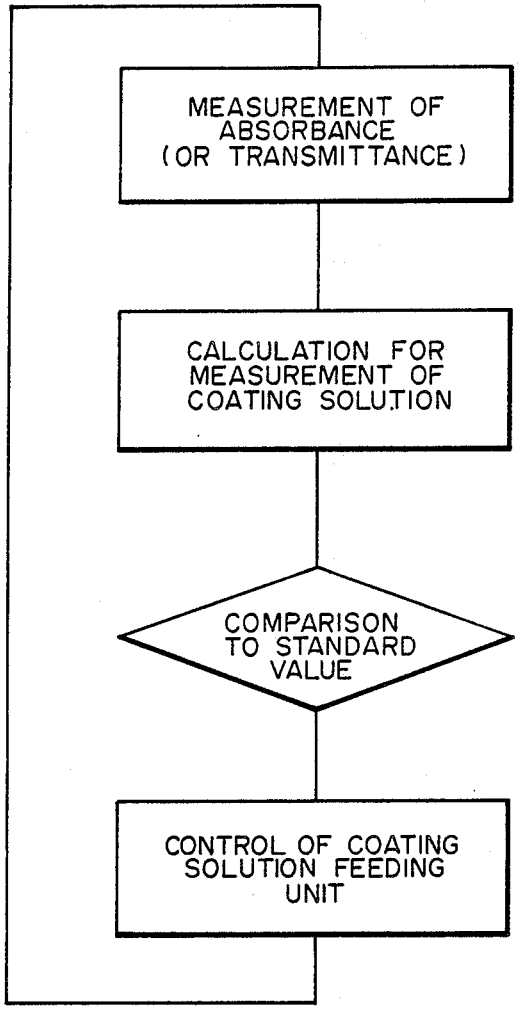
FIG. 1 is a flow chart representing the control steps in the apparatus for preparing the electrophotographic photosensitive member according to the present invention.

In the present invention, an output of the measurement of this absorbance (or transmittance) is further compared immediately to a specified value by means of a central arithmetic processing unit, and the information is fed back to a coating solution feeding unit separately provided for each of the respective charge-generating materials to automatically control the composition of the charge generation layer coating solution. A flow schematic illustrating that control is shown in FIG. 1.

In the present invention, as the manner by which the absorbance (or transmittance) is measured, there can be used ordinary spectrophotometers having from visible to infrared light sources. Provided that, in order to carry out the measurement in the real time, it is desired to provide a by-pass comprising an absorbance-measuring cell built in a charge generation layer coating solution feeding section of the coating apparatus.

Figure 2:
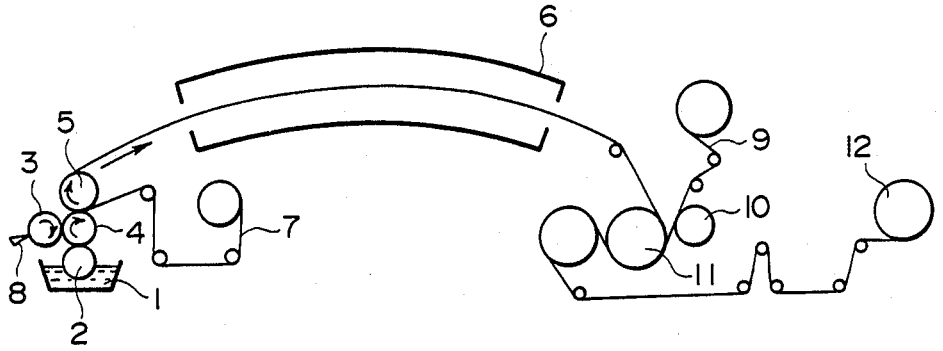
FIG. 2 and FIG. 3 are schematical views illustrating coating apparatus used in the present invention.

Most suited as the coating apparatus for the electrophotographic photosensitive members is a four-reverse-roll coater as shown in FIG. 2 in instances where the substrate is in the shape of a sheet.

In FIG. 2, a coating solution 1 is drawn up with an applicator roll 2, and the solution thickness on a coating roll 4 is evened by a metalling roll 3, followed by coating with a packing roll 5. The numeral 6 denotes a drying furnace; 7, a substrate; 8, a scraper edge; 9, a release paper; 10 and 11, nip rollers; 12, a coated sheet. The release paper 9 is wrapped for protecting the charge generation layer formed by the coating.

Figure 3:
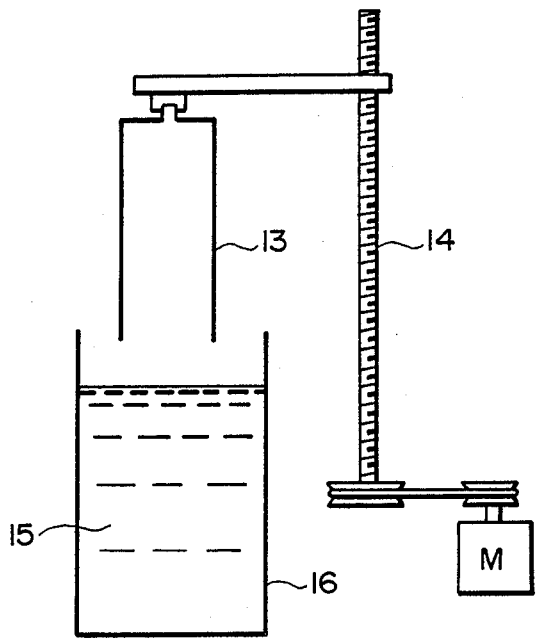

Alternatively, in instances in which the substrate is in a cylindrical shape, desirably suited is a dip coating method as shown in FIG. 3. In FIG. 3, the number 16 denotes a coating tank; and 15, a coating solution. An up-and-down screw 14 is rotated by means of a drive motor M to lift up or down a substrate 13.

Figure 5:
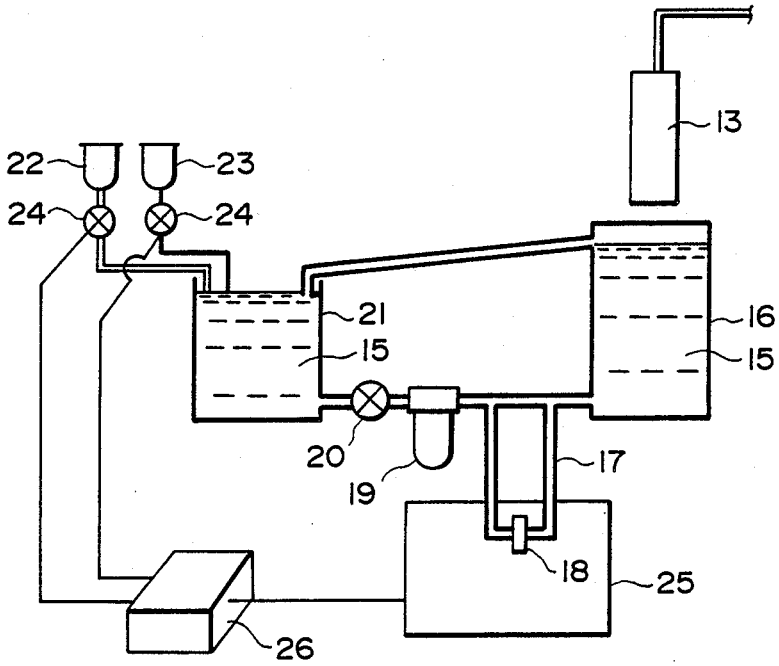
FIG. 5 is a schematic view of an example of the apparatus according to the present invention.

In other instances, as in FIG. 5, units; (e.g., 22 and 23) for feeding each of the respective coating solutions containing separately two or more kinds of charge-generating materials to be mixed are connected to a coating tank 21, so that any shorted charge generation layer coating solution is fed in order to correct the mixing ratio by a pulse pump 24 or the like, on the basis of signals in accordance with the output of absorbance measurement.

To describe the present invention in greater detail, the substrate for the electrophotographic photosensitive member is first prepared by forming a material such as a metal including aluminum, brass, stainless steel, etc., as well as plastics and paper, into a sheet or cylinder.

On the surface of the substrate, it is effective to provide a subbing layer comprising a resinous layer for the purposes of improving adhesion between the substrate and the charge generation layer, improving coating performance for the charge generation layer, protecting the substrate, covering any defects on the substrate, protecting the charge generation layer from any electrical destruction, improving charge-injection performance to the charge generation layer, and so forth. The resin for such purposes may include polyvinyl alcohol, poly-N-vinyl imidazole, polyethylene oxide, ethyl cellulose, methyl cellulose, an ethylene/acrylic acid copolymer, casein, gelatin, glue, polyamides, alkyd resins, etc. The subbing layer may have a film thickness of from about 0.1 to about 5 μm.

The charge-generating material includes materials such as pyrylium, thiopyrylium type dyes, phthalocyanine type pigments, anthanthrone pigments, dibenzpyrenequinone pigments, pyranthrone pigments, trisazo pigments, disazo pigments, azo pigments, indigo pigments, quinacridone type pigments, unsymmetrical quinocyanine, quinocyanine, etc., from which two or more kinds of charge-generating materials may be selected so that the sensitivities can be covered from the visible light to infrared regions, specifically the sensitivities between about 400 and 850 nm.

The charge generation layer coating solution can be obtained by separately dispersing these selected charge-generating materials optionally together with a solvent in binder resins such as polyester, polystyrene, polyvinyl chloride, polyvinyl acetate, acrylic resin, polyvinyl butyral, polyvinyl pyrrolidone, methyl cellulose, hydroxypropyl methyl cellulose and acrylates, and mixing them in an appropriate ratios. As for the dispersion method, there can be appropriately employed any known ones. This coating solution may be coated on the substrate, followed by drying, whereby the charge generation layer can be formed.

The charge generation layer comprises a thin film, having a film thickness generally of from 0.01 to 5 μm, preferably 0.05 to 3 μm.

The charge-transporting material used in the present invention may be any general charge-transporting materials used in the lamination type electrophotographic photosensitive members, and may include pyrazoline type compounds, hydrazone type compounds, stilbene type compounds, triphenylamine type compounds, benzidine type compounds, oxazole type compounds, etc.

To form the charge transport layer containing the charge-transporting material, a suitable binder may be selected to form a film. Resins used as the binder may include insulating resins as exemplified by acrylic resin, polyacrylate, polyester, polycarbonate, polystyrene, an acrylonitrile/styrene copolymer, an acrylonitrile/-butadiene copolymer, polyvinyl butyral, polyvinyl formal, polysulfone, polyacrylamide, polyamide, chlorinated rubber, etc. or organic photoconductive polymers as exemplified by poly-N-vinyl carbazole, polyvinyl anthracene, polyvinyl pyrene, etc.

The charge transport layer may have a film thickness generally of from 8 to 40 μm, preferably from 10 to 30 μm.

The charge transport layer may preferably be laminated on the charge generation layer from the viewpoint of durability, but they can be laminated in an adverse fashion to change the charging polarity.

The present invention will be specifically described below by giving Examples, which, however, show some examples of the present invention and of course by no means limit the present invention.

EXAMPLES

The present invention will be described below in a more specific manner by Examples.

EXAMPLE 1

On an aluminum cylinder (80 mm diameter, 350 mm length), a methanol solution of polyamide resin (trade name: Amilan CM-8000; available from Toray) was dip-coated to provide a subbing layer of 0.5 μm thick. Used as the charge-generating materials are the following two kinds:

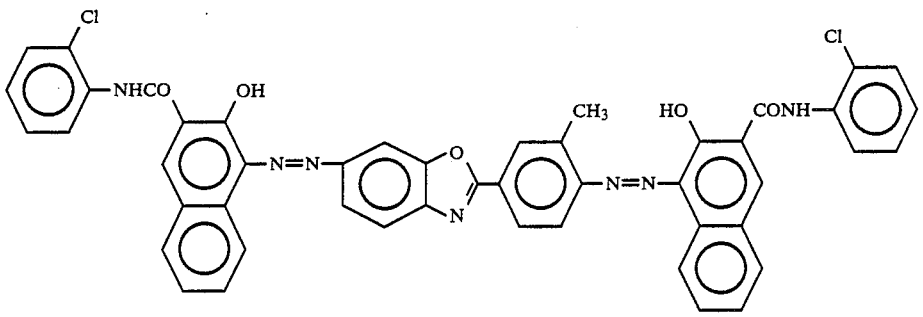

(I)

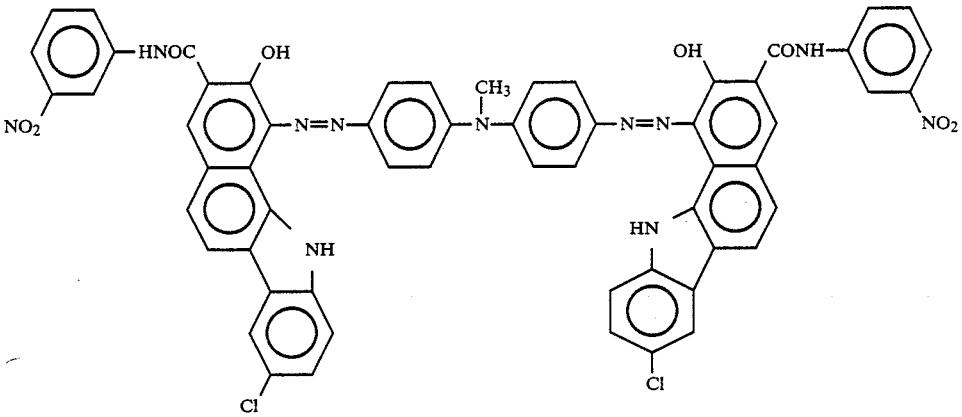

(II)

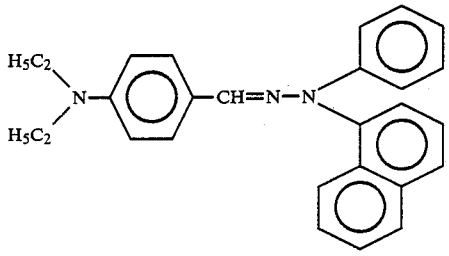

(III)

The material (I) had a maximum absorption wavelength of 550 nm, and material (II), 750 nm. First, 10 parts (by weight, the same hereinafter) of pigment (I), 5 parts of polyvinyl butyral resin (trade name: S-LEC BM-2; available from Sekisui Chemical Co., Ltd.) and 50 parts of cyclohexanone were dispersed for 20 hours by use of a sand mill apparatus using glass beads of 1 mm diameter. To the resulting dispersion, 450 parts of tetrahydrofuran were added to prepare charge generation layer coating solution (A).

Next, 10 parts of pigment (II), 8 parts of polymethyl methacrylate (trade name: BR-85; available from Mitsubishi Rayon Co., Ltd.) as a binder resin and 60 parts of cyclohexanone were dispersed for 50 hours by use of a sand mill apparatus using glass beads of 1 mm diameter. To the resulting dispersion, 200 parts of cyclohexanone and 240 parts of MEK were added to prepare charge generation layer coating solution (B).

In a solution obtained by mixing these coating solutions (A) and (B) in an equal amount, the above cylinder having been coated with the subbing layer was dipped to effect coating to form a charge generation layer of 0.3 μm thick.

Figure 4:
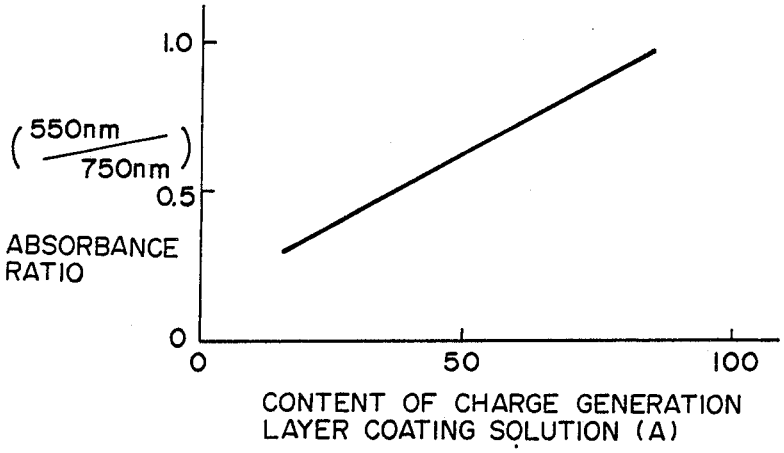
FIG. 4 is a graph of a calibration curve showing the relationship between the mixing ratio of two kinds of coating solutions and the absorbance ratio at respective absorption wavelengths.

Meanwhile, previously made were mixed solutions in which the mixing ratio of the charge generation layer coating solutions (A) and (B) were varied at several points around 1:1, and measured were the ratios of absorbances at 550 nm and 750 nm of the solutions to determine a calibration line. Such a calibration line is shown in FIG. 4.

Next, 8 parts of a charge-transporting material represented by formula (III):

10 parts of a styrene/acrylonitrile copolymer (MS-200; available from Shin Nippon Seitetsu Kagagu K.K.) and 60 parts of monochlorobenzene were mixed and dissolved by stirring with a stirring machine. The resulting solution was dip-coated on the charge generation layer, followed by drying to form a charge transport layer. This had a film thickness of 18 μm.

The whole of the coating apparatus used here for the charge generation layer is shown in FIG. 5.

The coating solution 15 is fed to a coating tank 16 from a coating solution tank 21 by means of a pump 20, in the course of which the coating solution is made to pass a filter 19 and further pass a cell 18 provided on the way of a by-pass 17. The cell is built in a spectrophotometer 25, and the output of absorbance is inputted to a central arithmetic processing unit 26.

On the other hand, charge generation layer coating solutions (A) and (B) are contained in feeding tanks 22 and 23, respectively, and fed to a coating solution tank 21 through a pulse pump 24. This pulse pump is driven based on signals sent in accordance with the output of absorbance from the above central processing unit.

Using such apparatus and following the above-described procedures, 10 pieces of the photosensitive members were manufactured in one production, which production was repeated for five times with a 2-day interval having been given between one production and the next. 50 pieces in total of the photosensitive member were obtained.

On the electrophotographic photosensitive members thus prepared, corona discharge of −5 kV was effected. The surface potential was measured after these photosensitive members were left to stand for 5 seconds at a dark place. Using two kinds of light sources, i.e., a halogen lamp light source (visible light sensitivity) and a semiconductor laser beam light source (780 nm), measured was the exposure amount E ½ (μJ/cm²) required for decaying the surface potential to a half was measured to make an evaluation of sensitivities.

The maximum and minimum of the sensitivities of 50 photosensitive members are shown below.

TABLE 1

| | E ½ (μJ/cm²) | |
|---|---|---|
| | Max. | Min. |
| Visible light: | 0.40 | 0.43 |
| 780 nm: | 1.02 | 1.05 |

Thus, it was possible to obtain photosensitive members showing characteristics very stable for a long period of time.

COMPARATIVE EXAMPLE

Example 1 was repeated but in the state that the central processing unit was stopped, in other words, in a system in which the measurement of absorbance and the supplement of charge generation layer coating solutions (A) and (B) were not carried out. Two (2) pieces of the photosensitive members were manufactured in one production, which production was repeated for three times with a 2-day interval having been given between one production and the next, and as a result, 6 pieces in total of the photosensitive member were obtained. The sensitivities were measured in the same manner.

TABLE 2

| | E ½ (μJ/cm²) | |
|---|---|---|
| | Max. | Min. |
| Visible light: | 0.41 | 0.48 |
| 780 nm: | 1.01 | 1.37 |

Thus, in view of a great scattering in the sensitivities and a lowering of the sensitivities particularly at 780 nm, the proportion of charge generation layer coating solution (B) is presumed to have become lower.

EXAMPLE 2

Charge generation layer coating solutions (C) and (D) were prepared in the following manner:

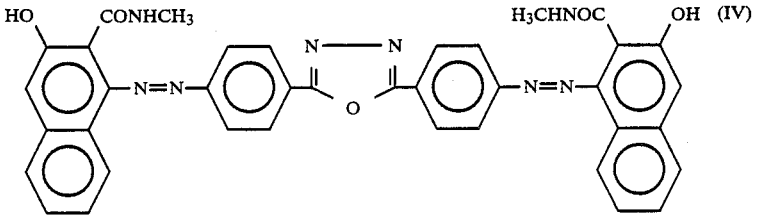

First, 10 parts of pigment (IV), 5 parts of cellulose acetate butylate (trade name: CAB; available from Eastman Kodak Co.) and 50 parts of cylcohexanone were dispersed for 20 hours by use of a sand mill apparatus using glass beads of 1 mm diameter. To the resulting dispersion, 450 parts of MEK were added to prepare charge generation layer coating solution (C).

Next, 10 parts of aluminum chloride phthalocyanine, 10 parts of polyester (Vylon 500; available from Toyobo Co., Ltd.) as a binder resin and 70 parts of cyclohexanone were dispersed for 10 hours by use of a sand mill apparatus using glass beads of 1 mm diameter. To the resulting dispersion, 200 parts of cyclohexanone and 230 parts of tetrahydrofuran were added to prepare charge generation layer coating solution (D).

Photosensitive members were prepared in the same manner as in Example 1 except that the measurement wavelengths were set to 556 nm and 750 nm. In this instance, the photosensitive members were prepared over 1 week to give 10 pieces in total, but there were also shown very uniform characteristics, and this coating apparatus was found to have operated effectively.

TABLE 3

| | E ½ (μJ/cm²) | |
|---|---|---|
| | Max. | Min. |
| Visible light: | 1.01 | 0.04 |
| 780 nm: | 1.42 | 1.44 |

EXAMPLE 3

An Al-deposited Myler (100 μm thick) was made ready for use as a substrate, and photosensitive members having the same constitution as in Example 1 were prepared by use of the roll coater as shown in FIG. 2. Here, the processing unit as used in the apparatus shown in FIG. 5 was connected to the part of the coating solution 1, and, while similarly controlling the mixing ratio of coating solutions, 5 lots of photosensitive sheets were prepared over one week. Also in this instance, there were obtained photosensitive members having uniform sensitivities.

TABLE 4

| | E ½ (μJ/cm²) | |
|---|---|---|
| | Max. | Min. |
| Visible light: | 0.40 | 0.42 |
| 780 nm: | 1.03 | 1.05 |

What we claim is:

1. A method for controlling the mixing ratio of two or more charge-generating materials in a charge generation layer coating solution comprising the steps of:

preparing a charge generation layer coating solution containing two or more charge-generating materials at a predetermined mixing ratio, said charge-generating materials having different maximum absorption wavelengths;

measuring the absorbance or transmittance of the charge generation layer coating solution at the respective maximum absorption wavelengths;

comparing the measured values of the absorbance or transmittance with a preexisting calibration curve, said calibration curve correlating the mixing ratios of the charge-generating materials with the absorbance or transmittance of said charge-generating materials at a specified wavelength;

supplementing each of the charge-generating materials to the charge generation layer coating solution, and controlling the supplement amount of the charge-generating materials in accordance with the comparison of the measured values of the absorbance or transmittance with the calibration curve to thereby correct, in real time, the mixing ratio of the charge-generating materials in the charge generation layer coating solution.

2. The method of claim 1, wherein said charge generation layer coating solution comprises a charge-generating material, binder resin and solvent.

3. The method of claim 1, wherein said charge-generating material is an organic material.

4. The method of claim 1, wherein each of said charge-generating materials is supplemented together with a binder resin and solvent.

* * * * *

UNITED STATES PATENT AND TRADEMARK OFFICE

CERTIFICATE OF CORRECTION

PATENT NO. : 4,974,964

DATED : December 4, 1990

INVENTOR(S) : TOSHIYUKI YOSHIHARA, ET AL.

It is certified that error appears in the above-identified patent and that said Letters Patent is hereby corrected as shown below:

COLUMN 1

Line 21, "a" should be deleted.
Line 47, "after" should read --often--.

COLUMN 2

Line 40, "DRAWING" should read --DRAWINGS--.
Line 63, "absorbence" should read --absorbance--.

COLUMN 3

Line 39, "units;" should read --units--.

COLUMN 4

Line 19, "ratios." should read --ratio.--.

COLUMN 7

Line 12, "mea-" should be deleted.
Line 13, "sured was" should be deleted.

COLUMN 8

Line 29, "Myler" should read --Mylar--.

UNITED STATES PATENT AND TRADEMARK OFFICE

CERTIFICATE OF CORRECTION

PATENT NO. : 4,974,964

DATED : December 4, 1990

INVENTOR(S) : TOSHIYUKI YOSHIHARA, ET AL.

It is certified that error appears in the above-identified patent and that said Letters Patent is hereby corrected as shown below:

COLUMN 10

Line 9, "claim 1," should read --claim 2,--.

Signed and Sealed this

Fourth Day of June, 1991

*Attest:*

*Attesting Officer*

HARRY F. MANBECK, JR.

*Commissioner of Patents and Trademarks*